US006536923B1

(12) United States Patent
Merz

(10) Patent No.: US 6,536,923 B1
(45) Date of Patent: Mar. 25, 2003

(54) OPTICAL ATTACHMENT FOR A LIGHT-EMITTING DIODE AND BRAKE LIGHT FOR A MOTOR VEHICLE

(75) Inventor: Bernd Merz, Frickenhausen (DE)

(73) Assignee: Sidler GmbH & Co., Tübingen (DE)

( * ) Notice: Subject to any disclaimer, the term of this patent is extended or adjusted under 35 U.S.C. 154(b) by 0 days.

(21) Appl. No.: 09/446,179

(22) PCT Filed: Jul. 1, 1998

(86) PCT No.: PCT/DE98/01802

§ 371 (c)(1),
(2), (4) Date: Dec. 17, 1999

(87) PCT Pub. No.: WO99/01695

PCT Pub. Date: Jan. 14, 1999

(51) Int. Cl.[7] ..... F21V 5/00

(52) U.S. Cl. ..... 362/327; 362/245; 362/309; 362/336

(58) Field of Search ..... 362/237, 241, 362/244, 245, 308, 309, 327, 329, 335, 336, 338, 800, 299

(56) References Cited

U.S. PATENT DOCUMENTS 2,254,962 A * 9/1941 Harris et al. ..... 362/327
5,813,743 A * 9/1998 Naka ..... 362/327

FOREIGN PATENT DOCUMENTS

| | | |
|---|---|---|
| DE | 930 593 | 10/1951 |
| DE | 43 05 585 A1 | 8/1994 |
| DE | 195 42 416 A1 | 5/1996 |
| DE | 195 07 234 A1 | 9/1996 |
| FR | 2627256 | 2/1988 |

* cited by examiner

*Primary Examiner*—Y. My Quach-Lee
(74) *Attorney, Agent, or Firm*—Paul Vincent

(57) ABSTRACT

An optical attachment 10 for a light source, in particular for a light-emitting diode 12, exhibits an inner lens area 14 which surrounds an optical axis 13 of the optical attachment 10 for inner light beams 15 emitted from the light source and an outer reflector area 16 for outer light beams 17 of the light source which surrounds the inner lens area 14 in a ring-like manner. Due to this combination of refraction in the inner lens area and reflection in the outer reflector area, the dimensions of the optical attachment can be kept relatively small and, in comparison to a lens or a reflector, more light can be collected and the point-shaped light diode can be imaged on the exiting side as a large area light appearance.

11 Claims, 5 Drawing Sheets

OPTICAL ATTACHMENT FOR A LIGHT-EMITTING DIODE AND BRAKE LIGHT FOR A MOTOR VEHICLE

BACKGROUND OF INVENTION

The invention relates to an optical attachment for a light source, in particular for a light-emitting diode (LED) with an inner lense area for inner light beams emitted by the light source, which surrounds the optical axis of the optical attachment and with an outer reflector area for outer light beams of the light source which surrounds the inner lense area in a ring-like manner.

Such an optical device for a light source became known, for example, by the DE-A-195 07 234.

Lenses and reflectors can be used in order to change the radiation distribution of the light emitted from a light-emitting diode. For example, a Fresnel step lense can be provided in the path of beam in front of the light-emitting diode which deflects the light emitted from the light-emitting diode in a particular solid angle into a smaller solid angle and particularly parallel to the optical axis of the lense. The light emitted from the point-shaped light-emitting diode appears more uniform because of such a Fresnel optic, however, not the complete solid angle of the light emitted from the light-emitting diode can be collected and deflected accordingly because of the limited expansion of a Fresnel step lense. Undesired scattering light effects can occur because of the light not collected which are to be avoided by all means with lamps that are used for example in the field of motor vehicles. In contrast, only the light emitted to the rear or to the side can be reflected accordingly for a light-emitting diode which is surrounded by a reflector, whereas the light emitted to the front still leaves to the front unchanged by the reflector under a relatively large solid angle.

Several light-emitting diodes are disposed of next to each other, preferably in a row, for the generation of a flat light image of a middle brake light which is provided as an additional brake light in the rear window or in the rear outer region of a motor vehicle where, because of the ever increasing brightness of the light-emitting diodes, fewer and fewer light-emitting diodes and in ever increasing distances are necessary for a particular brightness of the middle brake light. The individual light-emitting diodes, however, are recognized as point-shaped light sources by the viewer for greater distances between neighbouring light-emitting diodes in the brake light such that no coherent light image or light band is obtained.

The optical attachment which is known from the DE 195 07 234 A1 is used for the beam concentration of the light emitted from light emitting diodes and for that purpose exhibits a rotational symmetrical optical structure with an inner collector lense area and an outer reflector area. Because of the rotational symmetry all the axial cross sections of the optical structure are equal. For round optical attachments an optimal beam concentration of the light or a constant light distribution can be obtained over the complete exiting area of the optical attachment. For optical attachments which are not rotational symmetrical, for example rectangular or quadratic optical attachments, the light distribution along the edges of the optical attachment is lower than in between.

It is therefore the object of the present invention to develop an optical attachment, in particular for a light-emitting diode, which collects as much as possible of the light emitted to the front by the light-emitting diode and which can radiate on an exit plane which is as large as possible in a flat fashion.

SUMMARY OF THE INVENTION

This object is achieved according to the invention by an optical attachment exhibiting an effective cross-section on the light exiting side, which is not rotational symmetrical, and which optical attachment is divided in individual angular sectors with respect to the optical axis, where all axial cross-sections are identical within one angular sector and in that the axial cross-sections of two angular sectors differ by a scaling with respect to the front focal point of the optical attachment where the scaling is chosen according to the ratio of the respective greatest radial extension of the optical attachment in the two angular sectors.

In this inventive optical attachment only the inner light beams which pass close to the optical axis are deflected via the lense section to a light beam which exits, for example, as parallel light from the lense. In contrast, the outer light beams are deflected within the reflection area by reflection to light beams which, for example, exit the optical attachment in a parallel fashion as well. The dimensions of the optical attachment can be kept relatively small because of this combination of refraction in the inner lense area and reflection in the outer reflector area and, in comparison to a lense or a reflector, more light can be collected and the point-shaped light-emitting diode can be imaged on the exiting side as a light appearance with a large area.

Since all the axial cross-sections are identical of an optical attachment cross-section which is rotational symmetrical to the optical axis, the emitted light intensity by the optical attachment is only a function of the radius (that is the distance to the optical axis), i.e. the light distribution of a rotational symmetrical optical attachment is constant on a circle around the optical axis. For an exit surface which is not rotational symmetrical, for example for a quadratic or rectangular exit surface cross-section, the light distribution at the outer edge of the optical attachment in the corners of the exit area would be smaller without scaling than in between. In particular for optical attachments disposed of directly next to each other, different light intensity would be more strongly noticeable in the corners. With the optical attachment according to the invention, the loss of light intensity, which normally occurs in its corners, can be reduced or, in an ideal case, completely prevented. In this way, for example a point-shaped light-emitting diode can be imaged on the quadratic exit plane of the optical attachment with almost equal light intensity everywhere, i.e. in an ideal case on almost homogene light plane is obtained.

In a particularly preferred embodiment of the invention, the outer reflector area is directly adjacent to the inner lense area where the imagined light beam which enters into the inner lense area as well as in the outer reflector area separates both areas and determines the geometrical relationships between the two areas.

In preferred embodiments of the invention, the inner lense area is designed as a collector lense so that all the inner light beams of the light source exit the optical attachment under scattering angles as small as possible or as parallel as possible to the optical axis. For that purpose the inner lense area can exhibit, for example, a concave lense surface.

In a different advantageous further development of this embodiment, the inner lense area is designed as a Fresnel step lense in which the normally great thickness of a collector lense is reduced by a steplike configuration of the lense. The radiants of curvature of the individual zone areas of the Fresnel lense are different and chosen in such a way that the focal points of all zones fall together.

In a particularly preferred embodiment of the invention, an input opening is provided in front of the inner lense area, which is open towards the light source. The outer beams of the light source are introduced into the outer reflector area via the inner peripheral wall of the input opening. This inner peripheral wall is preferably a cylindrical surface passing coaxial to the optical axis. According to the indices of refraction of the optical attachment and the medium which is surrounding it, for example air, the light is refracted to or away from the optical axis when entering the inner peripheral wall. Such an input opening allows to grasp a large solid angle of the emitted light and particularly the light source can also be disposed of inside the input opening, whereby part of the light emitted to the rear by the light source can also be collected.

In order to direct the outer light beams within the outer reflector area to the front, as parallel as possible to the optical axis, an outer peripheral surface of the optical attachment is provided in a particularly preferred embodiment of the invention which reflects the outer light beams, which are introduced into the outer reflector area, to the front.

In an advantageous further development of this embodiment, the outer peripheral surface of the outer reflector area can be designed at least in parts parable-shaped or consisting of straight-line segments in relation to the optical axis of the optical attachment. This geometry has the essential advantage that all the outer beams which are reflected back from the outer peripheral surface are deflected parallel to the optical axis and can exit as parallel light from the optical attachment.

In order to avoid the shrinkage and hence the deformation of the surface which occur during the cool down period of a injection molding object, in particular for optical attachments made of synthetic material by injection molding, the optical attachment exhibits a central opening on the light-exiting side.

The production of the optical attachment by injection molding (procedure) can be considerably facilitated by a middle cylinder of the optical attachment within the inner lense area, which passes coaxial to the optical axis. The light beams passing through the middle cylinder, which are emitted by the light source almost parallel to the optical axis, are not influenced by this.

The invention also concerns a brake light, in particular a middle brake light, for a motor vehicle with several light sources, preferably light-emitting diodes (LED) arranged next to each other, preferably in a row, each having a previously described optical attachment placed in front of it. sources, preferably light-emitting diodes (LED) arranged next to each other, preferably in a row, each having a previously described optical attachment placed in front of it.

With this brake light according to the invention, an optic light band can be obtained which has essentially equal light intensity on its light surface for the viewer. The cross-sections of the optical attachments which are effective on the light exiting side complete each other to a fully flat cross-section without any gaps in between. Preferably, the cross-section of an optical attachment effective on the light exiting side is rectangular or quadratic in shape.

Further advantages of the invention can be gathered from the description and the drawing. Furthermore, the aforementioned and following characteristics can be used each individually or collectively in any arbitrary combination. The shown and described embodiments are not to be taken as a final enumeration but have exemplary character for the description of the invention.

The invention is shown in the drawing and is described in two examples of embodiments. In the drawing:

DESCRIPTION OF THE PREFERRED EMBODIMENT

The figures of the drawings show the inventive object in parts strongly schematised and are not necessarily to be taken according to scale.

Figure 1:
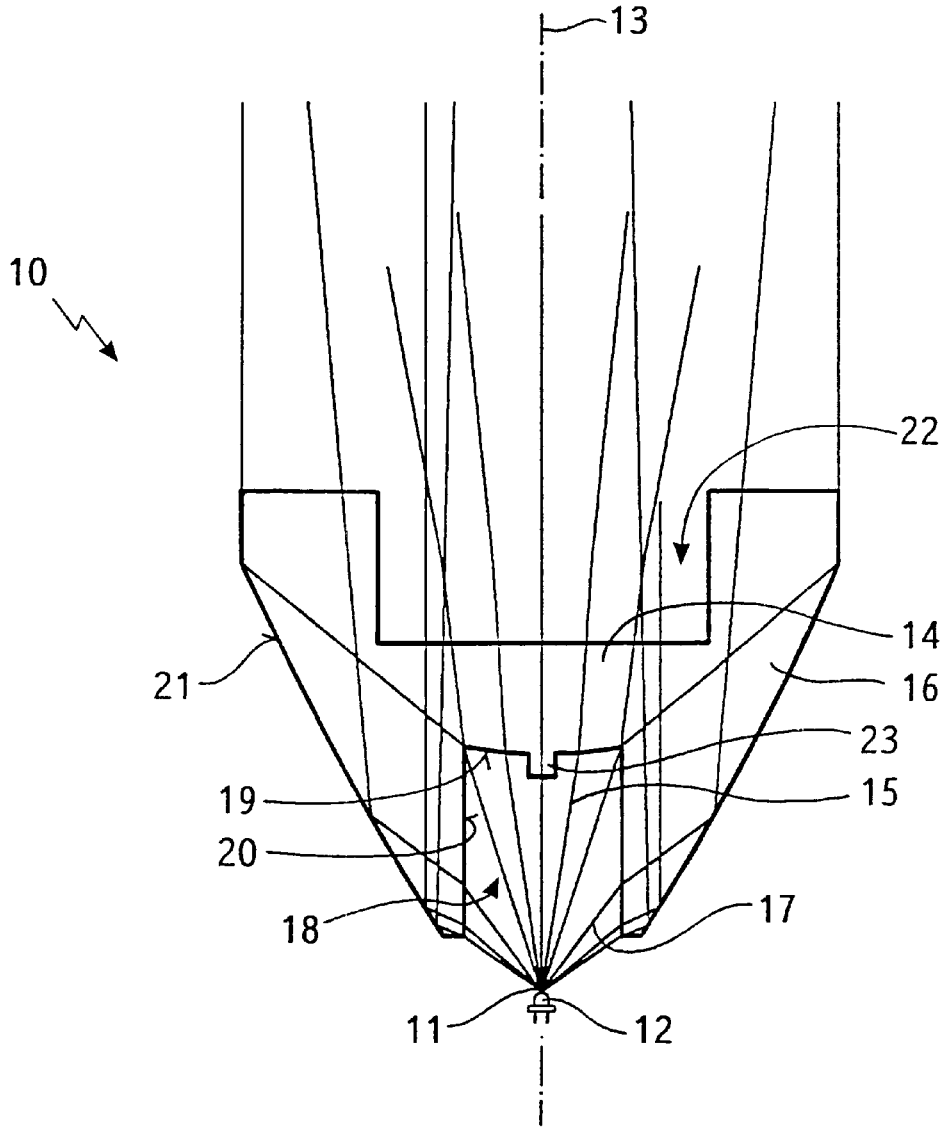
FIG. 1 shows in a simplified longitudinal section according to I—I in FIG. 3 a first example of an embodiment of an inventive optical attachment with an inner lense section designed as a collector lense and with schematically indicated path of beam through the optical attachment.
Figure 2:
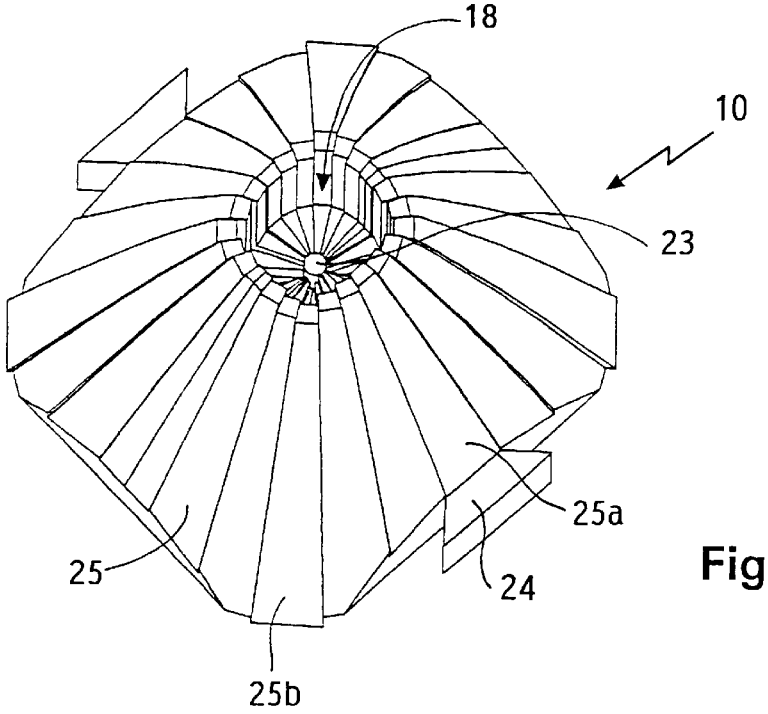
FIG. 2 shows a perspective view translationally from top on the light entering side of the optical attachment according to FIG. 1.
Figure 3:
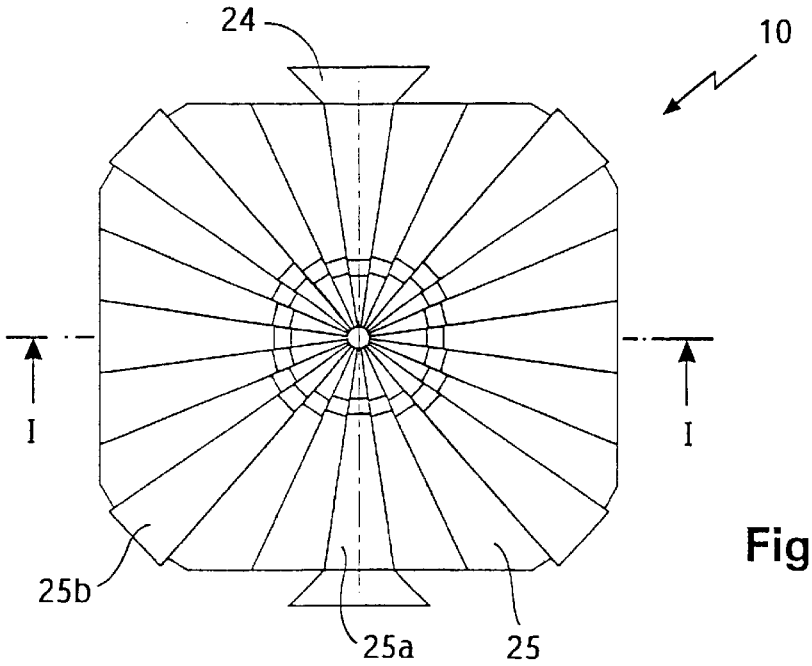
FIG. 3 shows a top view on the light entering side of the optical attachment according to FIG. 1.

In FIGS. 1 through 3 a first example of an embodiment of an optical attachment 10 is shown in the front focal point 11 of which a light-emitting diode (LED) 12 is disposed of. The purpose of the optical attachment 10 is to emit the light beams, which are emitted by the point-shaped light-emitting diode 12 to the front, on the light exiting side in a large area. For example, it can be an injection-molded plastic part made of acryl glass, in particular polymethylmethacrylate (PMMA).

For this reason, the optical attachment 10 exhibits an inner lense area 14, which surrounds its optical axis 13, for the inner light beams 15 which are emitted in an inner space angle by the light-emitting diode 12 and an outer reflector area 16 which surrounds this inner lense area 14 in a ring-like manner. The outer reflector area 16 is thereby directly adjacent to the inner lense area 14.

On the light entering side of the optical attachment 10, an open input opening 18 is provided in front of the inner lense area 14 which is open towards the front focal point 11, the base of which is designed as a collector lense with concave surface 19. The light beams emitted from the light-emitting diode 12 which fall on this concave surface 18 are the inner light beams 15, which are refracted to the optical axis 13 according to the concave surface 4& and then exit from the front side of the optical attachment 10.

The outer light beams 17, which do not fall on the concave surface 19 enter into the outer lense area 16 from the side via the cylindrical inner peripheral wall 20 which is centered with respect to the optical axis 13. Thereby they are deflected at the inner peripheral wall 20 according to the refraction relationship between air and the material of the optical attachment 10 away from the optical axis 13 and fall on the outer peripheral surface 21 of the optical attachment 10, which reflects the outer light beams 17 towards an exit at the front of the optical attachment 10. The contour of the outer peripheral surface 21 can be chosen either such that the incoming outer light beams 17 are reflected because of total reflexion, or the outside of the outer peripheral surface 21 can be provided with a mirror coating.

In the example of an embodiment according to FIG. 1, the outer contour of the outer peripheral surface 21 is chosen parable-shaped such that all the incoming outer light beams 17 coming in via the inner peripheral wall 20 into the outer reflection area 16 exit as parallel as possible to the optical axis 13 from the optical attachment 10.

Due to the central opening 22 provided on the light exiting side of the optical attachment 10 as well as because of the input opening 18, the optical attachment 10 exhibits only a small wall thickness so that compared with a massive embodiment, the shrinkage occurring with a spraying (=injection molding) process is considerably smaller. From the concave surface 19 of the inner lense area 14 protrudes a middle cylinder 23 pointing towards the front focal point 11 which facilitates the fabrication of the optical attachment 10 in a spraying procedure and does not influence the path of beam of the inner light beams 15.

FIGS. 2 and 3 show the light entering side of the optical attachment 10 which can be mounted via swallow-tail-like noses 24. The optical attachment 10 is divided in cross-section into individual angular sections (angular sectors 25) whereby the axial cross-sections of all the axial sections within one angular sector 25 are identical. Since the radial extension of the individual angular sectors 25—in contrast to a circular light exiting cross-section—are different for the rectangular light exiting cross-section of the example of an embodiment of the optical attachment 10, the diagonally extending angular sectors 25*b* are equal to the angular sectors 25*a* lying in the middle in between, except for a scaling with respect to the front focal point 11 of the optical attachment 10. Because of the scaling of the individual angular sectors 25, it is achieved that light is also deflected into the corner areas of the optical attachment 10 and also exits from there.

In FIGS. 4 through 8, which show a second example of an embodiment of a optical attachment 10', the parts functionally corresponding to the optical attachment 10 in the first example of an embodiment are characterized by a following '.

Figure 4:
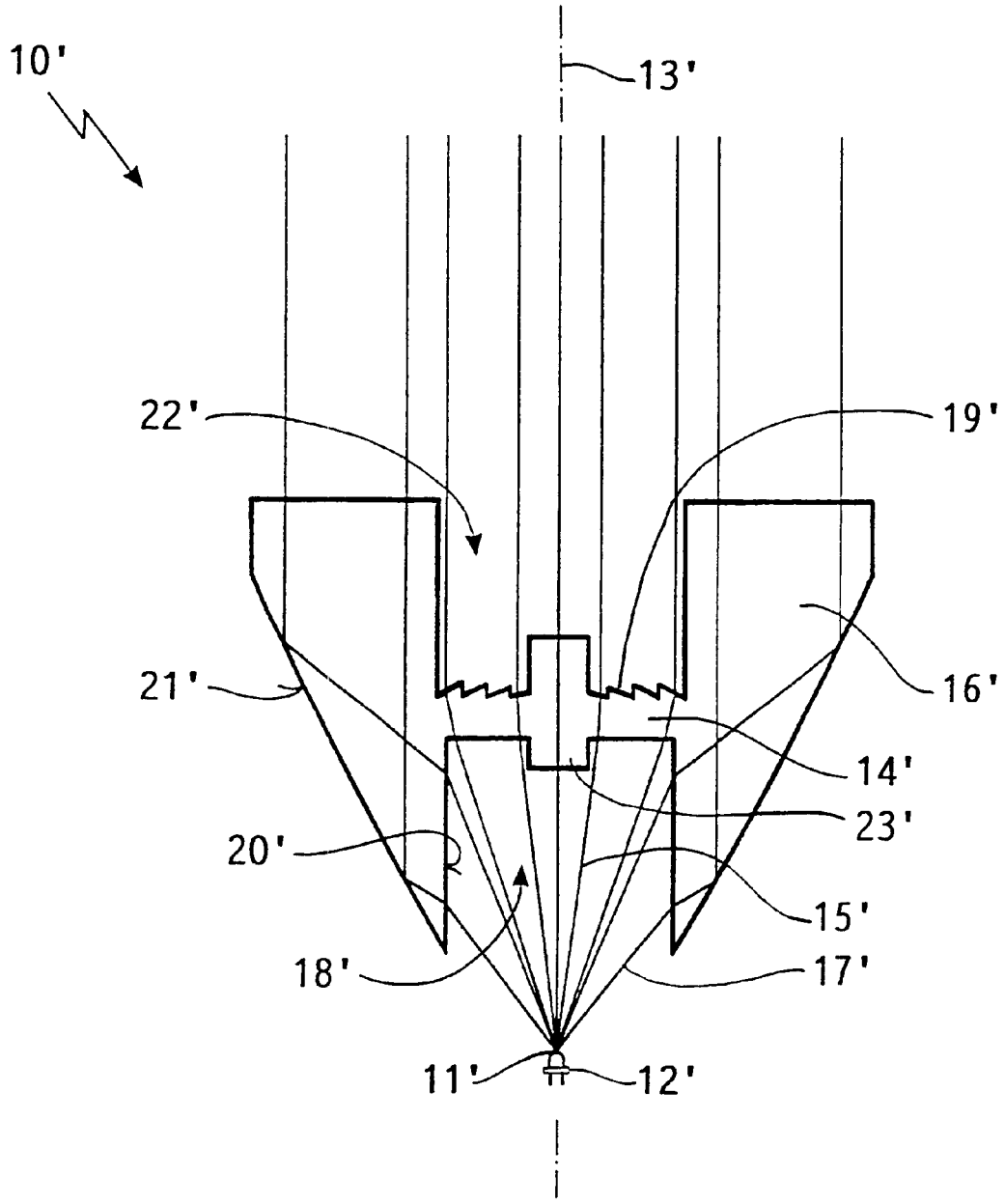
FIG. 4 shows in a simplified longitudinal section according to IV—IV in FIG. 6 a second example of an embodiment of an inventive optical attachment with an inner lense section designed as a Fresnel step lense and with a schematically indicated path of beam through the optical attachment.
Figure 8:
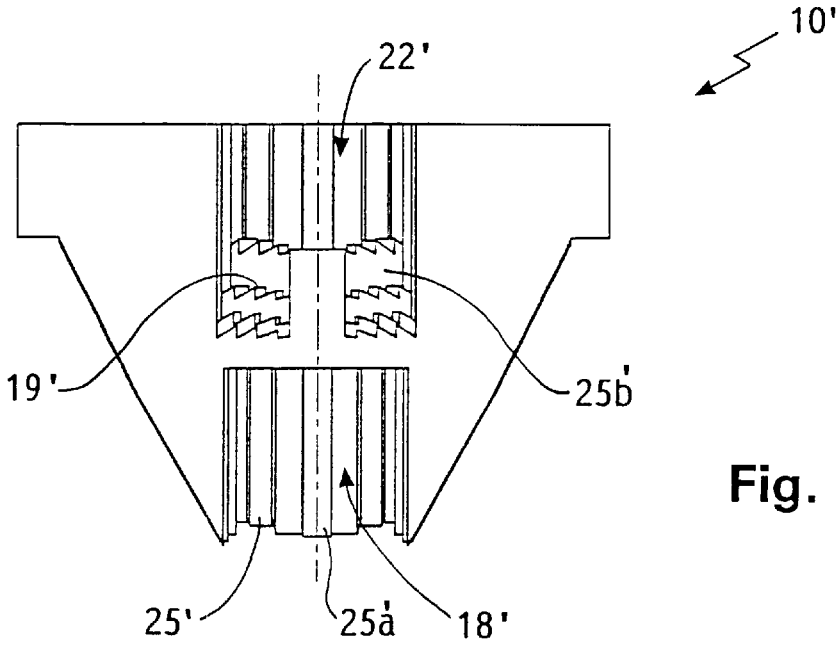
FIG. 8 shows in a longitudinal section according to VIII—VIII in FIG. 6 the optical attachment according to FIG. 4.

FIG. 4 shows parts which do not lie behind the cutting plane; those are shown in FIG. 8.

In the optical attachment 10', the inner light beams 15' emitted from the light-emitting diode 12 fall on the inner lense area 14' which is designed as a Fresnel step lense with steps 18'. Because of reasons related to the spraying process, the middle cylinder 23' extends on both sides of the inner lense area 14'. In the presented example of an embodiment, the outer peripheral area 21' is composed of two straight-line segments, whereby the outer peripheral surface can also be made of parabolic pieces or by the combination of parabolic and straight-line pieces.

From the path of beam shown in FIG. 4, it can be seen that the inner light beams 15' are refracted towards the optical axis 13' when entering into the inner lense area 14' and are then deflected by the steps 18' parallel to the optical axis 13'. Thereby, the dimensions of the Fresnel step lense and the thickness of the inner reflector are 14' are chosen in such a way that even the outermost of the inner light beams 15' is deflected by the outermost of the steps 18' in a parallel way after the passage of the inner lense area 14'. With this optical attachment 10', the complete light emitted to the front by a light-emitting diode 12 can be deflected to parallel light in a large area according to the path of beam in FIG. 4.

Figure 5:
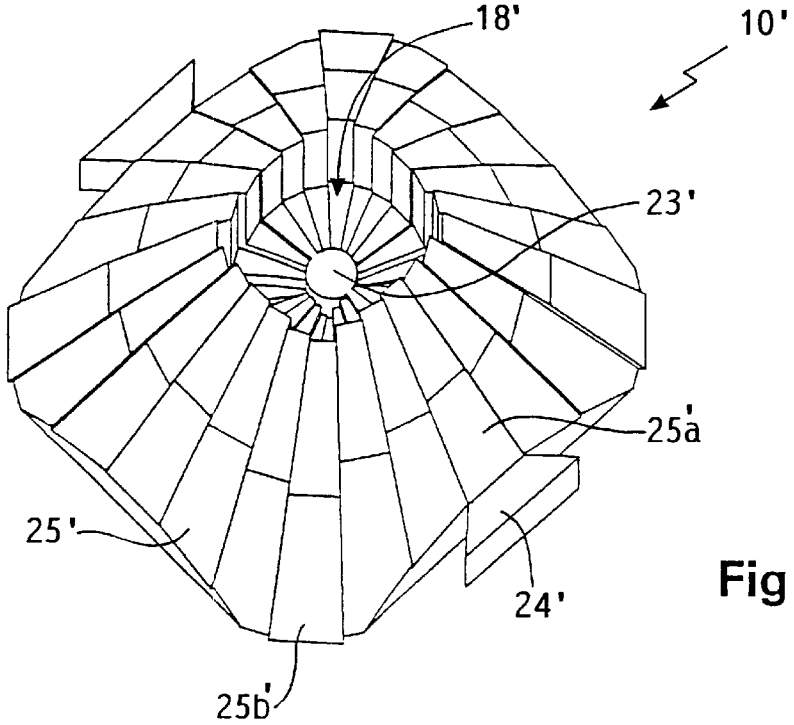
FIG. 5 shows a perspective view translationally from top on the light entering side of the optical attachment according to FIG. 4.
Figure 6:
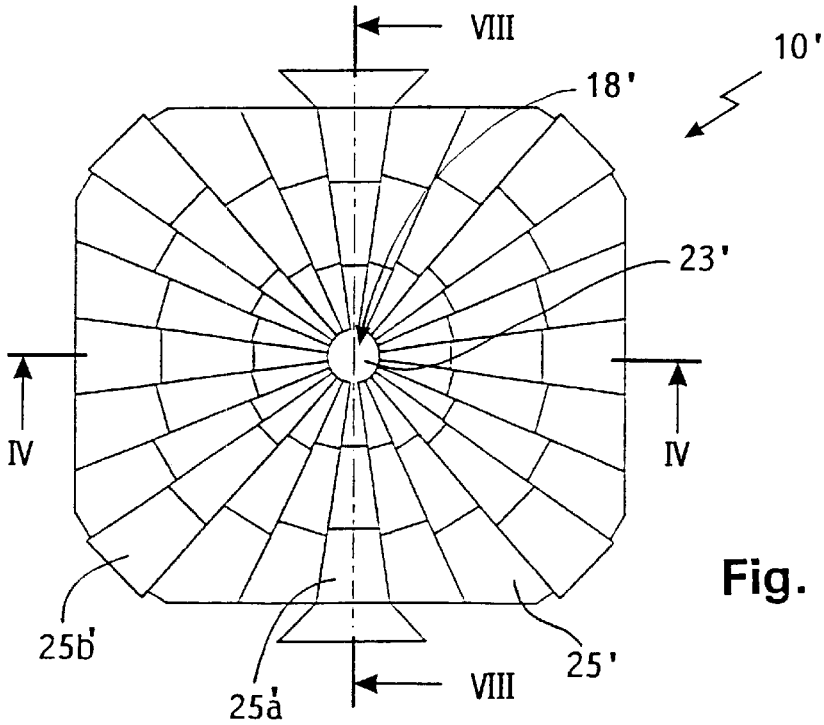
FIG. 6 shows a top view on the light entering side of the optical attachment according to FIG. 4.
Figure 7:
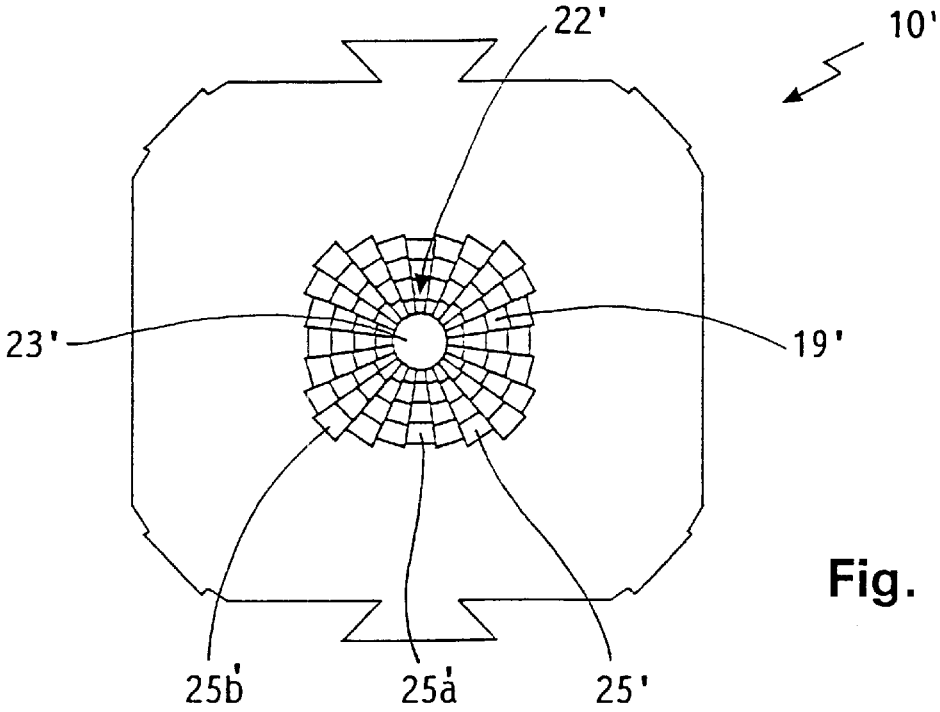
FIG. 7 shows a top view on the light exiting side of the optical attachment according to FIG. 4.

The views according to FIGS. 5 through 7 show that the optical attachment 10' is divided in cross-section into individual sectors 25' with respect to the optical axis 13'. Thereby, the axial cross-sections within one sector 25' are each identical, whereas the axial cross-sections of two sectors are equal except of a scaling with respect to the front focal point 11' of the optical attachment 10'. The scaling is chosen for each sector 25' such that the introduced light also exits from the corner areas of the light exiting area at the front of the lense 10'. Since the scaling occurs with respect to the front focal point 11', the steps 18' of the respective sectors 25' of the Fresnel step lense are offset to each other in direction of the optical lense 13' (FIG. 8). The top row of steps in FIG. 8 extends in direction of the diagonal of the light exiting area of the optical attachment 10'.

An optical attachment 10 for a light source, in particular for a light-emitting diode 12, exhibits an inner lense area 14 which surrounds an optical axis 13 of the optical attachment 10 for inner light beams 15 emitted from the light source and an outer reflector area 16 for outer light beams 17 of the light source which surrounds the inner lense area 14 in a ring-like manner. Due to this combination of refraction in the inner lense area and reflection in the outer reflector area, the dimensions of the optical attachment can be kept relatively small and, in comparison to a lense or a reflector, more light can be collected and the point-shaped light diode can be imaged on the exiting side as a large area light appearance.

What is claimed is:

1. An optical attachment for a light source, the light source having a focal point, the optical attachment having a center and an optical axis, the optical axis passing though the focal point and the center, the optical attachment comprising:

an azimuthally asymmetric inner lens for inner light beams emitted by the light source, said inner lens containing the center and surrounding the optical axis; and an azimuthally asymmetric outer reflector for outer light beams from the light source, said outer reflector surrounding said inner lens in a ring-like manner, wherein said inner lens and said outer reflector are formed by mutually adjacent individual angular sectors distributed azimuthally about said optical axis with each angular sector having a substantially constant axial cross-section in a plane passing though said angular sector and containing the optical axis, wherein axial cross-sections of separate angular sectors differ by a scaling with respect to the focal point of the optical attachment in dependence on a radial extension of a respective angular sector.

2. The optical attachment of claim 1, wherein said outer reflector is directly adjacent to said inner lens.

3. The optical attachment of claim 1, wherein said inner lens is a focussing lens.

4. The optical attachment of claim 3, wherein said inner lens is a stepped Fresnel lens.

5. The optical attachment of claim 1, wherein inner peripheral walls of said outer reflector define an input opening in front of said inner lens, said input opening being open towards the light source, wherein said outer light beams are introduced into said outer reflector through said inner peripheral wall.

6. The optical attachment of claim 1, wherein said outer reflector comprises an outer peripheral area to reflect said outer light beams in a forward direction.

7. The optical attachment of claim 6, wherein said outer peripheral area extends radially from the optical axis in at least one of parabolic and in straight line segments.

8. The optical attachment of claim 1, wherein said outer reflector defines a central opening located on a light exiting side of the optical attachment adjacent said inner lens.

9. The optical attachment of claim 1, further comprising a middle cylinder proximate said inner lens and extending coaxially to the optical axis.

10. The optical attachment of claim 1, further comprising means defining a break light for a motor vehicle and further comprising additional light sources disposed next to the light source and next to each other, wherein the optical attachment is disposed in front of each additional light source.

11. The optical attachment of claim 1, wherein said outer reflector is directly adjacent to said inner lens, wherein said inner lens is a stepped Fresnel focussing lens, and with an input opening in front of said inner lens, said input opening being open towards the light source, wherein said outer light beams are introduced via an inner peripheral wall of said input opening and into said outer reflector and with an outer peripheral area of said outer reflector to reflect said outer light beams which are introduced into said outer reflector to a front, wherein said outer peripheral area of said outer reflector is one of parabolic and straight-line segment shaped with respect to the optical axis, and having a central opening located on a light exit side of the optical attachment and with a middle cylinder proximate in said inner lens and extending coaxially to the optical axis.

* * * * *